United States Patent [19]

Ellis

[11] Patent Number: 4,676,085

[45] Date of Patent: Jun. 30, 1987

[54] ROLLING MILL FOR CONTROLLING THE CONTOUR OF A WORKPIECE

[75] Inventor: Robert H. Ellis, Oakmont, Pa.

[73] Assignee: Wean United Rolling Mills, Inc., Pittsburgh, Pa.

[21] Appl. No.: 760,868

[22] Filed: Jul. 31, 1985

[51] Int. Cl.[4] ..... B21B 37/08; B21B 31/08

[52] U.S. Cl. ..... 72/20; 72/21; 72/238; 72/243; 72/245

[58] Field of Search ..... 72/243, 241, 245, 20, 72/238, 21, 237

[56] References Cited

U.S. PATENT DOCUMENTS

| | | | |
|---|---|---|---|
| 2,985,042 | 5/1961 | Talbot | 72/243 |
| 4,494,396 | 1/1985 | Iwanami et al. | 72/243 |
| 4,539,834 | 9/1985 | Iwanami | 72/243 |

FOREIGN PATENT DOCUMENTS

| | | | |
|---|---|---|---|
| 50-32076 | 10/1975 | Japan | 72/243 |

*Primary Examiner*—Robert L. Spruill
*Assistant Examiner*—Steve Katz
*Attorney, Agent, or Firm*—Arnold B. Silverman; Suzanne Kikel

[57] ABSTRACT

A back up roll assembly for supporting an intermediate roll and an upper work roll consists of a plurality of rotatable rollers spaced apart on a common shaft by fixed saddles and in engagement with the intermediate roll. The number of saddles exceeds one more than the number of rollers so that the back up roll assembly begins and ends with a saddle, each saddle being engaged by a piston cylinder assembly mounted in a frame, which frame takes up all of the rolling load and adds rigidity to the compensating system. Each piston cylinder assembly controls the positioning of its saddle and its neighboring rollers to exert a localized influencing effect onto the intermediate roll to compensate for, and/or control roll deflection.

2 Claims, 3 Drawing Figures

ROLLING MILL FOR CONTROLLING THE CONTOUR OF A WORKPIECE

BACKGROUND OF THE INVENTION

1. Field of the Invention

This invention relates to an improved construction of a rolling mill which reduces the thickness of a workpiece, and more specifically, to means for controlling the position of segmented areas along the length of at least one work roll to compensate, and/or control its deflection caused by the rolling load.

2. Description of the Prior Art

It is well known in the metal producing industry in connection with reduction of strip or plate in a rolling mill to provide one or a combination of several devices and/or methods for compensating for roll deflection caused by the rolling forces which tend to separate the work rolls. This separation also produces a certain profile in the material, including the amount of crown and edge drop along the width of a workpiece and which affects flatness. Some of these methods and/or devices include providing: roll bending devices between the necks or ends of the work and/or back up rolls; internal hydraulically controlled roll crown; a stand where the work roll or the intermediate roll is displaced axially; and/or a central roller or a plurality of casters disposed along the length of a work roll or intermediate roll, which roller or casters are vertically displaceable relative to the work roll.

The two latter arrangements are particularly disclosed in U.S. Pat. Nos. 2,985,042 and 3,596,489. In the '042 patent, a centrally disposed roller cooperates with a cambered work roll to attempt to only control the amount of crown in the rolled product; and if it has any application to present day requirements is limited to a small range of varying width product.

The '489 patent discloses a plurality of casters mounted on a flexible beam which is acted upon by several piston cylinder assemblies to apply a counter force to the upper work roll. Even though this arrangement may be used to control both crown and edge drop across the width of the product, there are several inherent disadvantages. Since the casters are small and mounted on projections on the under side of a beam this system is limited as to the degree of rolling forces it is able to withstand, and for this reason, if it has any application, would be limited to use in the finishing rolling operation rather than in the primary operation. Secondly, since the piston cylinder assemblies contact the flexible beam along a surface opposite to where the casters are mounted, their effect involves a time lag and lost inertia, resulting in less control of the casters, and thus, less effective counter deflection action upon the work roll. Another disadvantage is in its complicated design of spaced apart separately mounted beams and the great number of casters need to span the length of the work roll.

Other systems for compensating against roll deflection appear in U.S. Pat. Nos. 4,059,976; 4,212,504; 4,222,255; and 4,480,459, which involve complicated designs either of a supporting roll with internal pressure elements which may or may not require additional roll bending means or lateral support means for the work rolls; or of an hydrostatic bearing member whereby oil is delivered directly onto the back up roll resulting in an unsightly and unsafe working environment, in addition to its undesireable marking of the product.

SUMMARY OF THE INVENTION

Therefore, with the foregoing in mind, it is the primary object of the present invention to provide a new and improved construction of a rolling mill of the aforementioned type which is not afflicted with the previous discussed drawbacks and limitations of the prior art.

Another object of the present invention is to provide a construction and arrangement for compensating for roll deflection of at least one work roll of a reduction rolling mill which is simple, neat, and compact in design, easily removable as a unit, useable in both newly constructed and existing rolling mills, sturdy enough to withstand extreme rolling forces necessary of both hot and cold rolling of a rolled product to control its profile - crown and edge drop - and flatness thereof.

Another object of the present invention is to provide a construction and arrangement for compensating for roll deflection in a reduction rolling mill which permits a more direct, quicker, and finer control in applying a localized counteracting force influence along the length of a deflected work roll.

A further object of the present invention is to provide a construction and arrangement for compensating for roll deflection in a rolling mill which can be employed to selectively influence the profile i.e. the amount of crown and the edge drop as well as the flatness in the width of a ferrous or non ferrous strip-like product and to be able to attain this control for wider ranges of widths.

Still a further object of the present invention is to provide a construction and arrangement for compensating for roll deflection where the counter force influencing rollers are mounted on a non-rotatable shaft nested in a relatively rigid U-frame member.

More particularly, it is an object of the present invention to provide in a rolling mill stand for reducing the thickness of a strip-like workpiece comprising: a pair of spaced apart rigidly connected housings, a pair of work rolls supported by said housings, one work roll positioned adjacent the other between which said workpiece passes for its said reduction, a support roll assembly supported by said housings and associated with each of said work rolls, said pair of work rolls and its said associated support roll assembly further constructed and arranged to deflect a certain amount upon said passage of said workpiece between said work rolls, a support roll assembly for counteracting the deflection of one of said work rolls comprising: a non-rotating shaft member, a plurality of spaced-apart roller bearing assemblies, each rotatably mounted around said shaft member and constructed and arranged to extend toward said one work roll, a plurality of saddle members fixedly mounted on said shaft, each of which is located between two adjacent roller bearing assemblies and further constructed and arranged on said shaft as to have an extended portion away from said roller bearing assemblies, and pressure exerting means, for and in an engagement with each said extended portion of said saddle members, constructed and arranged in a manner that upon operation thereof said pressure exerting means positions its said associated engaged saddle member in addition to said two adjacent roller bearing assemblies of said associated saddle member a predetermined distance relative to said one work roll to cause said adjacent roller bearing assemblies of said associated engaged saddle member to exert pressure such as to effect compensation for said deflection of said one work roll.

It is yet a further object to provide in a rolling mill stand according to the immediately preceding object, a rigid frame structure for receiving and supporting the support roll assembly and the piston cylinder assemblies in a nested relationship, with an intermediate roll located between the support roll assembly and the upper work roll, which work rolls are smaller in diameter than those provided in conventional rolling mills.

These and other objects and advantages of the present invention will be better understood and appreciated when the following description is read along with the accompanying drawings of which:

DETAILED DESCRIPTION OF THE PREFERRED EMBODIMENT

In view of the teachings and disclosure of the above prior art patents and particularly U.S. Pat. No. 2,985,042 incorporated herein by reference, certain details of the principles and construction of the present invention will not be repeated.

Figure 1:
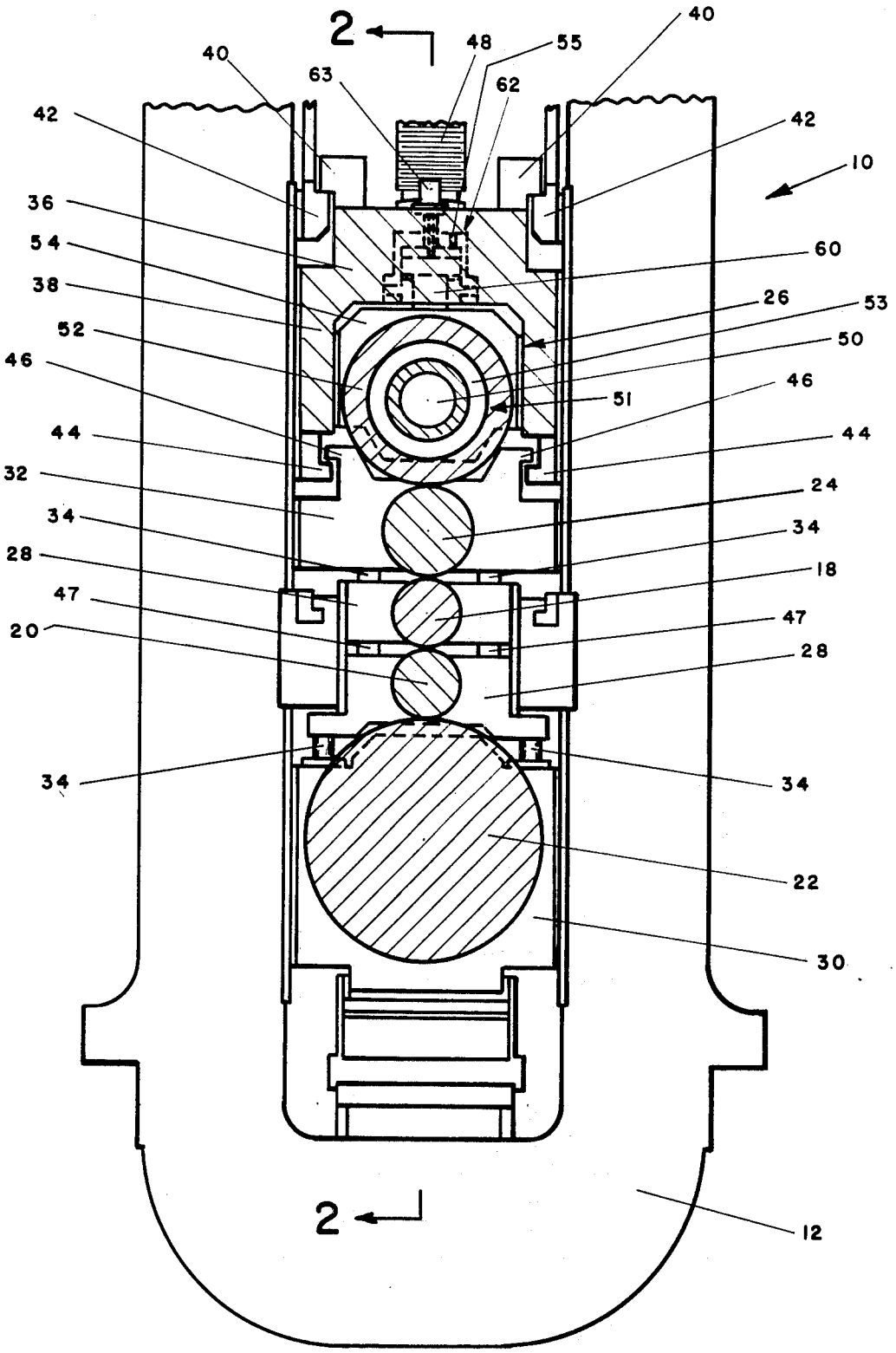
FIG. 1 is a cross-sectional elevational view of the present invention broken away at the top for brevity; and taken along lines 1—1 of FIG. 2.
Figure 2:
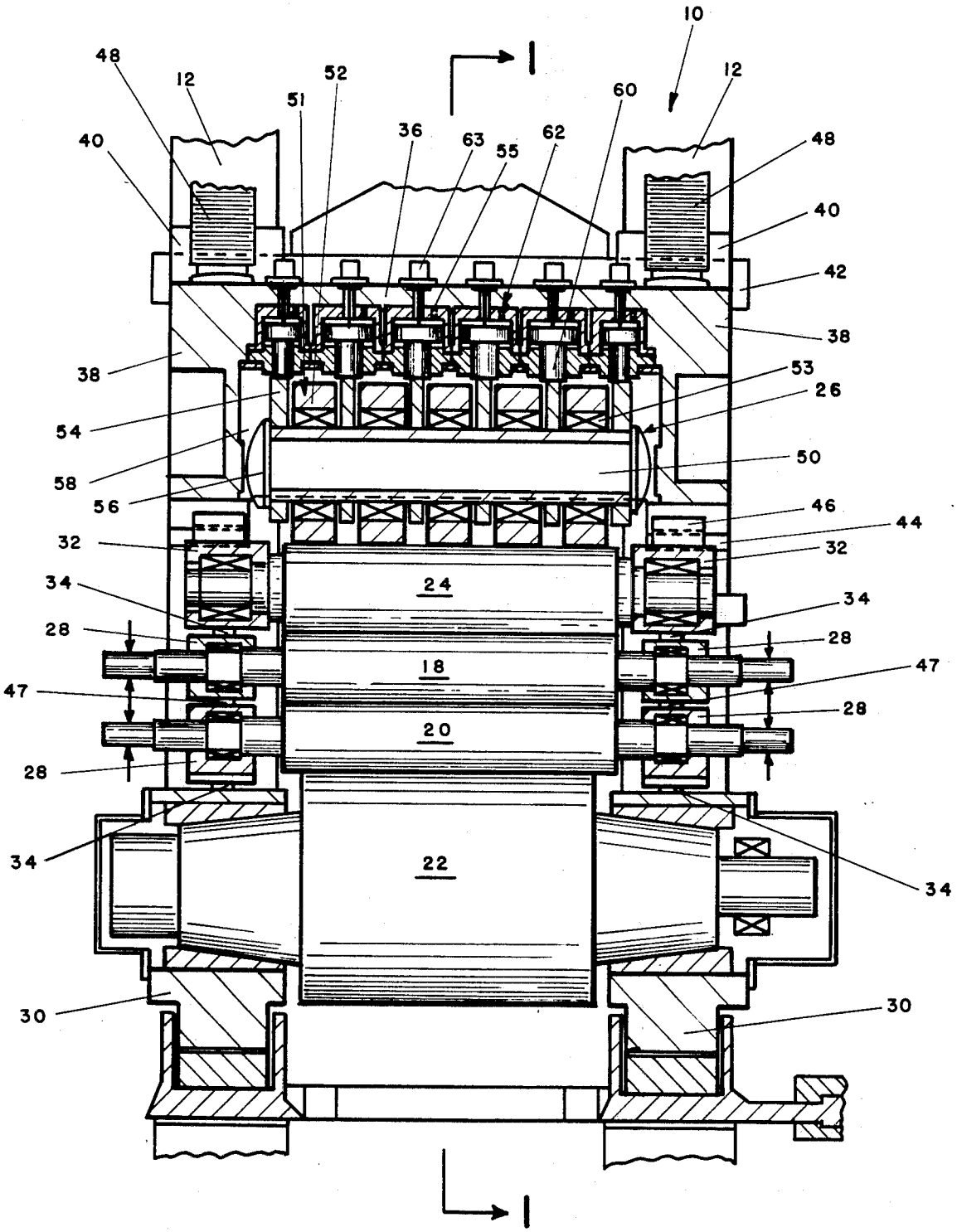
FIG. 2 is a cross-sectional view taken along lines 2—2 of FIG. 1.

FIGS. 1 and 2 illustrate a stand 10 which may be one or several in a tandem rolling mill for processing a hot or cold strip-like material or workpiece, such as an aluminum or steel strip or plate. Stand 10 comprises a pair of spaced apart up right arranged housings 12 secured together at the top and bottom by well-known separators (not shown), and in which there is included an upper and lower work roll 18,20 respectively. A lower back up roll 22 is in engagement with and supports lower work roll 20; an intermediate roll 24 is in engagement with upper work roll 18; and a support roll assembly 26 supports both intermediate roll 24 and upper work roll 18. Work rolls 18, 20 are supported at their ends in windows of housings 12 by suitable chock bearings 28, and are driven through well-known power means (not shown).

Both lower back up roll 22 and intermediate roll 24 are also mounted in the windows of housings 12 through suitable chock bearings 30, 32, and are indirectly driven by work rolls 18, 20. These work rolls 18, 20 are considerably smaller in diameter than in conventional rolling mills and back up roll 22 is larger in diameter than work rolls 18, 20. The above incorporated '042 patent sets forth the advantages of employing these smaller diameter work rolls which reduce the separating force between the work rolls and therefore reduces the rolling load for a given reduction.

Chock bearings 28 of work rolls 18, 20 are nested in the housings and are spaced away from chock bearing assembly 30 of lower back up roll 22 through piston cylinder assemblies 34 (shown only in FIG. 1) which provide negative roll bending to the work rolls to decrease the crown thereof which is well known in the rolling mill industry.

Associated with intermediate roll 24 is a support roll assembly 26 which is housed in a rigid frame structure 36 which is U-shaped in cross section (as shown in FIG. 1) whose side walls 38 has top projections 40 which as shown in FIG. 1 are supported by corresponding projections on carrier beams 42. Carrier beams 42 slide in housings 12 and are operated to lift frame structure 36 upwardly for a roll gap positioning of the upper rolls and for a roll changing operation. It will be appreciated that well known means will be employed to support the rolls in stand 10 and to support and remove work rolls 18, 20 from stand 10 during a roll changing operation. While not shown, according to customary rolling mill practice, means will be provided for retaining the roll support assembly 26 in its operating position within frame assembly 36 when intermediate roll 24 is removed from the mill. Frame assembly 36 and roll support assembly 26 come out of housings 12 as a unit and while being removed they are supported by carrier beams 42. When removed as a unit after intermediate roll 24 is removed, frame 36 is carried by carrier beams 42, and a central extension (not shown) of these members 42 spanning the housings 12.

As particularly illustrated in FIG. 1, lower projections 44 of frame structure or assembly 36 are engageable with corresponding projections 46 on chock bearing assemblies 32 of intermediate roll 24 so that when frame assembly 36 is raised, intermediate roll 24 can also be raised away from work rolls 18, 20 in a roll changing operation of work rolls 18, 20. Between chock bearing assemblies 32 and 28 of intermediate roll 24 and upper work roll 18, respectively also are located piston cylinder assemblies 34 which provide negative roll bending to work rolls 18, 20 similar to those between the chock assemblies of the lower back up roll 22 and lower work roll 20. Provided between the chock assemblies 28 of the upper and lower work rolls are well-known positive roll bending and balancing devices 47, which separate and increase the crown of work rolls 18, 20. Screw down means 48 located on the top portion of housings 12 adjust the roll gap between work rolls 18, 20 in a conventional manner.

In referring to FIG. 2, support roll assembly 26 comprises a non-rotating shaft 50. Mounted on shaft 50 is a number of freely rotatable and equally spaced apart dead shaft assemblies 51 consisting of a roller 52 and a bearing 53, (only one of which is numbered) and a number of saddles 54, fixed on shaft 50, each of which is located on opposing sides of assembly 51. The number of saddles 54 is one more than that of assemblies 51 so as to begin and end an alternating sequence of saddle-assembly-saddle. Mounted to the ends of shaft 50 and abutting end saddles 54 is a member 56 for retaining assemblies 51 and saddles 54 on shaft 50.

As shown in FIG. 1, saddles 54 are generally rectangular with flat side surfaces extending around its outer periphery where three of the flat sides fit into a cut-out section 58 of frame assembly 36. In FIG. 2, this cut-out section 58 is shown to extend along the length of frame assembly 36 which spans across the two housings 12. The receiving of saddles 54 and rollers 52 in cut-out section 58 of frame assembly 36 is such that a clearance exists between frame assembly 36 and the top of saddles 54. While the lateral sides of saddles 54 fit into a lining in side walls 38 of frame assembly 36. Extending into the clearance at the top of each saddle 54 is a piston rod 60 of a relatively large piston cylinder assembly 62 whose cylinder is mounted through suitable means (not shown) in frame assembly 36, and whose operation provides for little or no relative movement between support roll assembly 26 and frame assembly 36. Each piston cylinder assembly 62 has a position transducer 63 which is mounted in frame assembly 36 and which detects the positioning of piston rod 60 in its respective cylinder (more about which will be discussed shortly).

The piston cylinder assemblies 62 at the opposed ends of support roll assembly 26 has less effective pressure areas in their cylinders than those arranged towards the center since there is less load acting on the ends of support roll assembly 26.

The diameter of roller 52 of each assembly 51 is shown to be greater than that of intermediate roll 24 and either one of work rolls 18, 20. This diametrical dimension for each roller 52 is also greater than the length of each saddle 54 so that the mounting of rollers 52 and saddles 54 on shaft 50 is such that each roller 52 directly contacts an adjacent portion of the roll body of intermediate roll 24 with no interference from saddles 54. The portion of each saddle 54 remote from intermediate roll 24 extends beyond roller 52 to be directly contacted by its respective piston rod 60.

As shown in FIG. 2, the thickness of each saddle 54 is substantially less than the thickness of the roll body length of each roller 52 so that the total number of rollers create a substantial contacting surface area along the overall length of intermediate roll 24. Since work roll 18 contacts roll 24, which in turn is to be contacted by each roller 52, rotation of intermediate roll 24 caused by upper work roll 18 will cause each roller 52 to rotate, while needless to say, saddles 54 remain stationary on shaft 50.

Each piston cylinder assembly 62 is servo-valve controlled and hydraulically operated to appropriately position its rod 60 relative to its associated saddle 54, which in effect, may position the saddle's two immediately neighboring rollers 52 a predetermined distance toward or away from intermediate roll 24. Hydraulic fluid is delivered through channel 55 communicating with the cylinder of assembly 62. Saddles 54 provide enough strength to effectively transfer pressure from piston rod 60 into shaft 50 for vertical displacement thereof. Since each piston cylinder assembly 62 is capable of being individually controlled, the amount of vertical displacement of different longitudinal segments of shaft 50 may vary, and in most cases, will vary. In order to reduce edge drop in the workpiece, the pressure in a piston cylinder assembly 62 located near the ends of the workpiece may be less than those at the center, in which case, an adjacent piston cylinder assembly acting on the same roller as that of the cylinder assembly at the workpiece's ends will create a differential positioning and thus a differential pressure against that same roller. The pressure in each cylinder is measured by a pressure transducer (not shown).

The effective pressure of each cylinder against saddle 54 is distributed through shaft 50 into its associated neighboring rollers 52. When roller 52 is vertically displaced toward intermediate roll 24, this displacement will be consequentially interrupted by the resistance of intermediate roll 24 resulting in rollers 52 exerting a pressure value against the roll 24. Conversely, if the pressure in each cylinder is such that no displacement of saddles 54 occurs, then little or no effective pressure differential is transferred against intermediate roll 24.

Before discussing the operation, it will be appreciated in the above described arrangement that the roll gap of the mill will be set by positioning the mill screw 48 to fix the positioning of frame 36. Since the aggregate pressures of the several piston cylinder assemblies 62 will always be equal to the maximum rolling load, there will be no vertical displacement of the shaft 50 of the support roll assembly 26 in a vertical direction during rolling of the product and the only movement will be the arcuate counterdeflecting control movement of the assemblies 51 of support roll assembly 26 which would redistribute the aggregate pressure.

Upon operation of stand 10, a workpiece enters into the gap between rotating work rolls 18 and 20. Depending on the physical characteristics of the stand 10 and the workpiece, work rolls 18, 20 as well as intermediate roll 24, support roll assembly 26, and lower back up roll 22, will deflect an amount proportional to the rolling load imposed upon them. This rolling load is immediately transferred to rollers 52 through saddles 54 into the hydraulic fluid of cylinder assemblies 62 where it is taken up by frame assembly 36 and through housings 12.

Figure 2A:
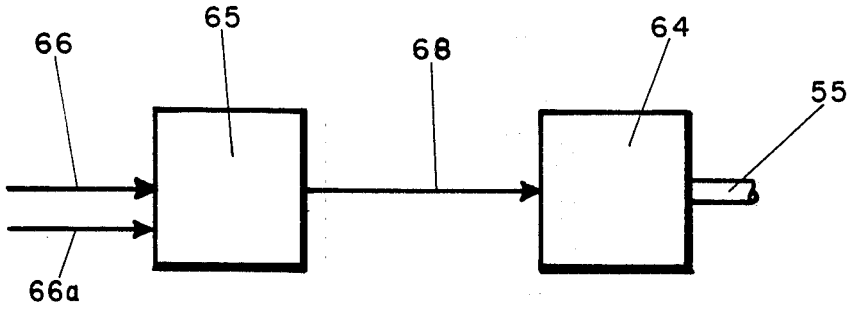
FIG. 2A is a diagram of a control system for the present invention.

The data obtained from position transducer 63 connected to each piston cylinder assembly 62 or which may be obtained from a pressure transducer (not shown) associated with each piston cylinder assembly 62 is compared with a desired shapemeter signal. If an error signal is detected by the shapemeter then a signal is sent to the appropriate servo-valve 64 for operation of its respective cylinder assembly. This control is shown at 65 in FIG. 2A, which receives two input signals, one representing a shapemeter error signal 66 and the second a signal at **66*a* representing a combined desired reference and position feedback signal. Output error signal at 68 controls the amount of fluid delivered to the appropriate cylinder 62 to effect the proper counter deflection of the assembly 26**.

The compensating capacity of support roll assembly 26 can be sufficient to give symmetry between the top and bottom surfaces of the workpiece, and in some cases, may involve cambering or crowning of the rolls.

If additional edge control of the workpiece is required, roll bending devices 47 located between the work rolls 18, 20 and as indicated by the arrows, may be employed to cooperate with support roll assembly 26 to create a counteracting moment to the bending of work rolls 18, 20 in an appropriate direction. Through controlled operation of each piston cylinder assembly 62, rollers 52 are simultaneously positioned a selective distance to limit or restrict the amount of deflection occurring in intermediate roll 24, and hence, in upper work roll 18 so that a desireable pass is obtained between work rolls 18, 20; i.e. if desired, the amount of crown and the edge drop normally occurring in the workpiece can be controlled to the extent the workpiece is rolled with a substantial uniform cross section or desired profile thickness. Since the pressure value in each piston cylinder assembly 62 can be varied, the operator of stand 10 is able to obtain a desired profile. In some cases, it may be desirous only to eliminate edge drop but still retain some crown in the workpiece. Here, the pressure value in the piston cylinder assemblies 62 located near the ends of the workpiece will be less than those toward the center of the workpiece. It is apparent from the foregoing that the present invention can be utilized to its utmost efficiency on any width workpiece.

In addition to the above advantages of the present invention, another advantage is the relationship of rigid frame 36 and the stroke of the cylinder assembly 62, which because of the rigidity of frame structure 36, the amount of the piston rod's stroke can be made small to thereby reduce losses due to the flexibility of the components of the system and to overcome lag time response problems.

As alluded to, this arrangement for compensating for roll deflection as presented by the present invention ultimately results in affecting the flatness or shape in the workpiece. The wavy edges and center buckles normally developed by non-uniform tension forces being applied along the workpiece's width and length where excessive residual stresses occur, can be substantially decreased or eliminated when the teachings of the present invention is used either solely or in conjunction with the other well known methods and/or devices for compensating for roll deflection.

As mentioned earlier, each piston cylinder assemblies 62 are operated through the servo-valve 64. These may be controlled either individually or in unison by the mill operator or by a computer control porcess which may include unit 65. Also, as mentioned earlier, the top and bottom portions of stand 10 has substantially the same rigidity factor so that substantially equal reactive forces are applied to the top and bottom surfaces of the workpiece to produce symmetry in the profile of the workpiece. Even though not shown as such, but mentioned earlier in an added effort to compensate for the deflection of work rolls 18, 20, work rolls 18 and 20 and/or back up roll 22 may be crowned or cambered.

Intermediate roll 24 is essentially employed between support roll assembly 26 and upper work roll 18 to prevent marking of rollers 52 against the workpiece. The diametrical dimensions of the intermediate roll 24 and that of each roller 52 may be chosen to substantially equal that of lower back up roll 22. This option to choose the diameters of the rolls is especially useful in existing mills where the stand 10 can be retrofitted to include the incorporation of an intermediate roll 24 and support roll assembly 26 of the present invention and smaller diameter work rolls as compared to conventional rolling mills.

While the present invention is disclosed in connection with the preferred embodiment, it should be understood that there may be other embodiments which fall within the scope and spirit of the invention as defined by the following claims. For instance, lower back up roll 22 can be substituted by an intermediate roll 24 and support roll assembly 26. Also, the present invention, in some instances, may employ only support roll assembly 26 associated with each work roll 18, 20 without the use of intermediate roll 24 to compensate for roll deflection.

In accordance with the provisions of the patent statutes, I have explained the principles and operation of my invention and have illustrated and described what I consider to represent the best embodiment thereof.

I claim:

1. In a rolling mill stand for reducing the thickness of a strip-like workpiece which creates a rolling load in its reduction, comprising:

a pair of spaced apart upright housings, a pair of work rolls having rolling load transmitting faces and received in said housings, one work roll positioned adjacent the other between which a gap is formed in which said workpiece passes for reduction thereof, and which work rolls deflect under said rolling load, a pair of back-up rolls each received in said housings and each relatively disposed adjacent to a different one of said work rolls generally axially co-planar therewith and having rolling load receiving faces substantially equal in length to said rolling load transmitting faces of said work rolls, said pair of work rolls and said back up rolls deflecting under the total rolling load in said co-planar direction upon said passage of the workpiece in said gap between said work rolls, rigid movable frame means disposed between said housings operatively arranged in a direction for receiving the total rolling load in said stand, means in said housings for adjusting said frame means to set said gap between said work rolls, a support roll assembly mounted in said rigid frame means and adjacent to at least one of said back up rolls located on the side furtherest away from said gap, said support roll assembly being self-contained in said frame means and comprising:

a non-rotating shaft member arranged parallel to at least said pair of work rolls, a plurality of spaced-apart roller bearing assemblies, each rotatably mounted on said shaft member for engagement with said one back-up roll, a plurality of saddle members fixedly mounted on said shaft member, each of which is located between two adjacent roller bearing assemblies, said shaft, said roller bearing assemblies and said saddle members composed of parts transmitting said total rolling load to said rigid frame means, a plurality of hydraulic piston cylinder assemblies, each being effective for one of said saddle members, and having a cylinder mounted in said frame means and a piston in engagement with one of said saddle members, means connected to and communicating with said plurality of piston cylinder assemblies for supplying an aggregate pressure to said piston cylinder assemblies which is always substantially equal to said total rolling load of said stand, and a plurality of position transducer means carried by said rigid frame means, one connected to said piston rod of each said piston cylinder assemblies and having means for detecting the actual positioning of said piston rod, and further including control means for comparing said actual positioning with a desired positioning to create an error signal for effecting delivery of hydraulic pressure to certain piston cylinder assemblies thereby to effect a compensation for said deflection of said back-up rolls and said work rolls in a manner that said set roll gap is controlled and roll deflection is selectively controlled along the axial length of said rolls.

2. In a rolling mill stand according to claim 1, wherein said rolling mill comprises a first adjacent housing portion, a first said work roll, a first said back-up roll, said frame and said support roll assembly on a first co-planar side of said gap, and a second adjacent housing portion, a second work roll, and a second back up roll on a second co-planar side of said gap opposite to said first co-planar side, and wherein said frame and support roll assembly on said first co-planar side is constructed to have a rigidity whereby the rigidity of said first and second co-planar sides of said mill is substantially equal.

* * * * *